US006711373B2

(12) United States Patent
Naito

(10) Patent No.: US 6,711,373 B2
(45) Date of Patent: Mar. 23, 2004

(54) PRINTER AND TRANSFER UNIT

(75) Inventor: Hiroaki Naito, Hyogo (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/117,216

(22) Filed: Apr. 8, 2002

(65) Prior Publication Data

US 2003/0138277 A1 Jul. 24, 2003

(30) Foreign Application Priority Data

Jan. 24, 2002 (JP) ..... 2002-015487

(51) Int. Cl.[7] ..... G03G 15/16
(52) U.S. Cl. ..... 399/310; 399/315; 399/316
(58) Field of Search ..... 399/297, 310, 399/311, 315, 316, 317

(56) References Cited

U.S. PATENT DOCUMENTS 4,171,899 A * 10/1979 Yanagawa et al. ..... 399/317
4,896,191 A * 1/1990 Ohyabu et al. ..... 399/316 X
4,903,080 A * 2/1990 Taniguchi ..... 399/315
5,130,752 A * 7/1992 Morishita et al. ..... 399/315
5,225,879 A * 7/1993 Hayashida ..... 399/315
5,552,873 A * 9/1996 Hirao et al. ..... 399/315

* cited by examiner

*Primary Examiner*—Sandra Brase
(74) *Attorney, Agent, or Firm*—Westerman, Hattori, Daniels & Adrian, LLP

(57) ABSTRACT

A printer includes a photosensitive member having a surface for forming a toner image and a transfer unit for transferring the toner image onto a recording paper. The transfer unit includes a transfer member arranged to face the recording paper for passing a transfer current, a discharge member arranged downstream from the transfer member in the recording paper transport direction to face the recording paper for passing a discharge current for performing discharge of the recording paper, a first guide arranged upstream from the transfer member in the recording paper transport direction for guiding the recording paper, and a second guide arranged downstream from the first guide in the recording paper transport direction for guiding the recording paper. The second guide includes a contact portion located between the transfer member and the discharge member in the recording paper transport direction for contact with the recording paper. The contact portion is positioned adjacent an unshielding portion for exposing the discharge member relative to the recording paper.

10 Claims, 5 Drawing Sheets

PRINTER AND TRANSFER UNIT

BACKGROUND OF THE INVENTION

1. Field of the Invention

The present invention relates to a printer for performing electrophotographic image printing on a recording paper. The present invention also relates to a transfer unit to be incorporated in such a printer.

2. Description of the Related Art

Conventionally, an electrophotographic printer is provided with a photosensitive member having a surface for forming an electrostatic latent image, a developer unit for developing the electrostatic latent image into a toner image, a transfer unit for transferring the toner image onto a recording paper, and a fixing unit for fixing the toner image on the recording paper. FIG. 6 illustrates an example of prior art transfer unit incorporated in such a printer.

The transfer unit Ue shown in FIG. 6 is arranged in facing relationship to a surface 90*a* of a photosensitive drum 90. The transfer unit Ue includes a transfer wire 93, a discharge wire 94, a first guide 91 and a second guide 92. A transfer current flows through the transfer wire 93 for transferring a toner image formed on the surface 90*a* of the photosensitive drum 90 to a recording paper P. For example, while the toner image formed on the photosensitive drum 90 is negatively charged, the transfer current passing through the transfer wire 93 positively charges the recording paper P for attracting the toner to the recording paper P. On the other hand, a discharge current flows through the discharge wire 94 for releasing the electric charge on the recording paper P after the image transfer. The discharging operation by the discharge wire 94 prevents the recording paper P from adhering to various parts of the printer in the subsequent paper transport path. The first and the second guides 91, 92, functioning to guide the recording paper P, may be made of an wear-resistant metal for avoiding early wearing due to contact with the recording paper P. The first and the second guides 91, 92 are spaced from each other in a recording paper transport direction so as not to shield the transfer wire 93 and the discharge wire 94 relative to the photosensitive drum. Specifically, the first guide 91 is arranged upstream from the transfer wire 93 in the recording paper transport direction, whereas the second guide 92 is arranged downstream from the discharge wire 94 in the recording paper transport direction.

In the printer including the above-described transfer unit Ue, the length La of the paper P (the length in the paper transport direction) winding around the photosensitive drum 90 should be as small as possible to obtain a high quality printed image for the following reasons. Since the recording paper P is transported by a transport mechanism (not shown) provided separately from a rotary mechanism (not shown) of the photosensitive drum 90, there exists a slight difference between the transport speed v1 of the recording paper P and the peripheral speed v2 at the surface 90*a* of the photosensitive drum 90. Therefore, when the winding length La is large, the recording paper P may become loose, or the drum 90 may rub against the paper P. This causes an improper toner image transfer to the recording paper P, resulting in a degradation of the printed image quality.

However, in the prior art transfer unit Ue, the first and the second guides 91, 92 are arranged at front positions which entirely avoid the transfer wire 93 and the discharge wire 94. Therefore, the distance Lb between the first and the second guides 91, 92 is relatively large, which inevitably increases the winding length La of the recording paper P about the photosensitive drum 90. As described above, such a large winding length La causes a deteriorated printed image.

SUMMARY OF THE INVENTION

It is therefore an object of the present invention to provide a printer capable of providing a high quality printed image by reducing the winding length of a recording paper about a photosensitive member.

Another object of the present invention is to provide a transfer unit which may be advantageously incorporated in such a printer.

In accordance with a first aspect of the present invention, there is provided a printer comprises a photosensitive member having a surface for forming a toner image; a transfer member for passing a transfer current for transferring the toner image onto a recording paper, the transfer member being arranged to face said surface of the photosensitive member; a discharge member for passing a discharge current for performing discharge of the recording paper, the discharge member being arranged downstream from the transfer member in a recording paper transport direction to face said surface of the photosensitive member; a first guide arranged upstream from the transfer member in the recording paper transport direction for guiding the recording paper; and a second guide arranged downstream from the first guide in the recording paper transport direction for guiding the recording paper. The second guide includes a contact portion located between the transfer member and the discharge member in the recording paper transport direction for contact with the recording paper, and the contact portion is positioned adjacent an unshielding portion for exposing the discharge member relative to said surface of the photosensitive member.

The technical advantages of the printer having the above-described structure will be specifically described later with reference to preferred embodiments of the present invention.

In one embodiment, the second guide extends from a first position located between the transfer member and the discharge member in the recording paper transport direction to a second position located downstream from the discharge member in the recording paper transport direction, and an edge of the second guide located at the first position serves as the contact portion. In this embodiment, the unshielding portion may be provided by a single slit formed in the second guide along and adjacent said edge of the second guide. Alternatively, the unshielding portion may be provided by a row of slits formed in the second guide along and adjacent said edge of the second guide.

In another embodiment, the transfer member and the discharge member are separated from each other by a partition wall which also serves as the second guide, and the contact portion is provided by a forward end of the partition wall. In this embodiment, the forward end of the partition wall serving as the contact portion may be bent downstream in the recording paper transport direction.

According to a second aspect of the present invention, there is provided a transfer unit to be brought into contact with a recording paper, comprising a transfer member arranged to face the recording paper for passing a transfer current; a discharge member for passing a discharge current for performing discharge of the recording paper, the discharge member being arranged to face the recording paper downstream from the transfer member in a recording paper transport direction; a first guide arranged upstream from the transfer member in the recording paper transport direction for guiding the recording paper; and a second guide arranged downstream from the first guide in the recording paper transport direction for guiding the recording paper. The second guide includes a contact portion located between the transfer member and the discharge member in the recording paper transport direction for contact with the recording paper, and the contact portion is positioned adjacent an unshielding portion for exposing the discharge member relative to the recording paper.

Other objects, features and advantages of the present invention will become clearer from the detailed description given below with reference to the accompanying drawings.

DETAILED DESCRIPTION OF THE PREFERRED EMBODIMENTS

Preferred embodiments of the present invention will be described below in detain with reference to the accompanying drawings.

Figure 1:
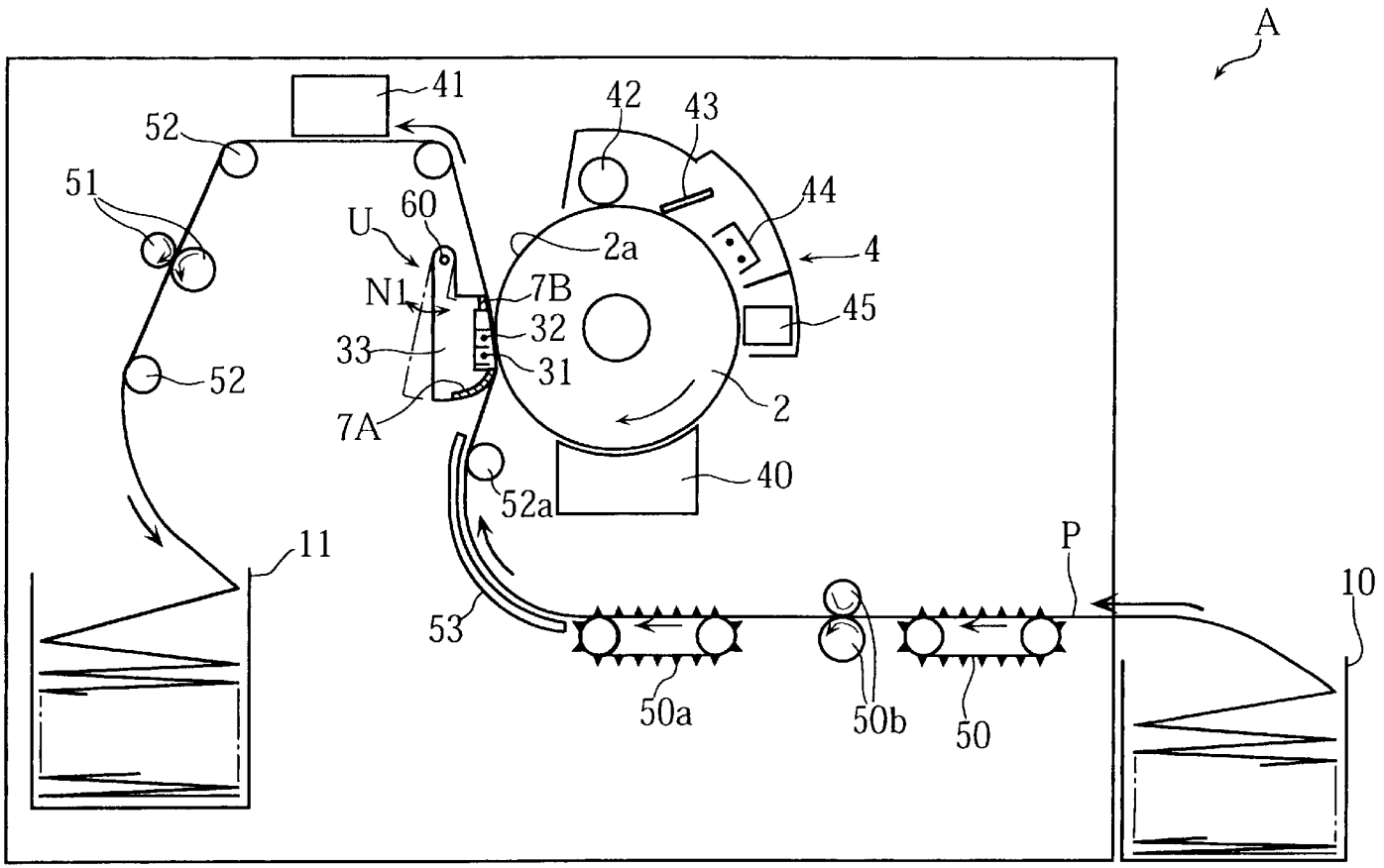
FIG. 1 is a schematic side view illustrating a printer according to a first embodiment of the present invention.
Figure 2:
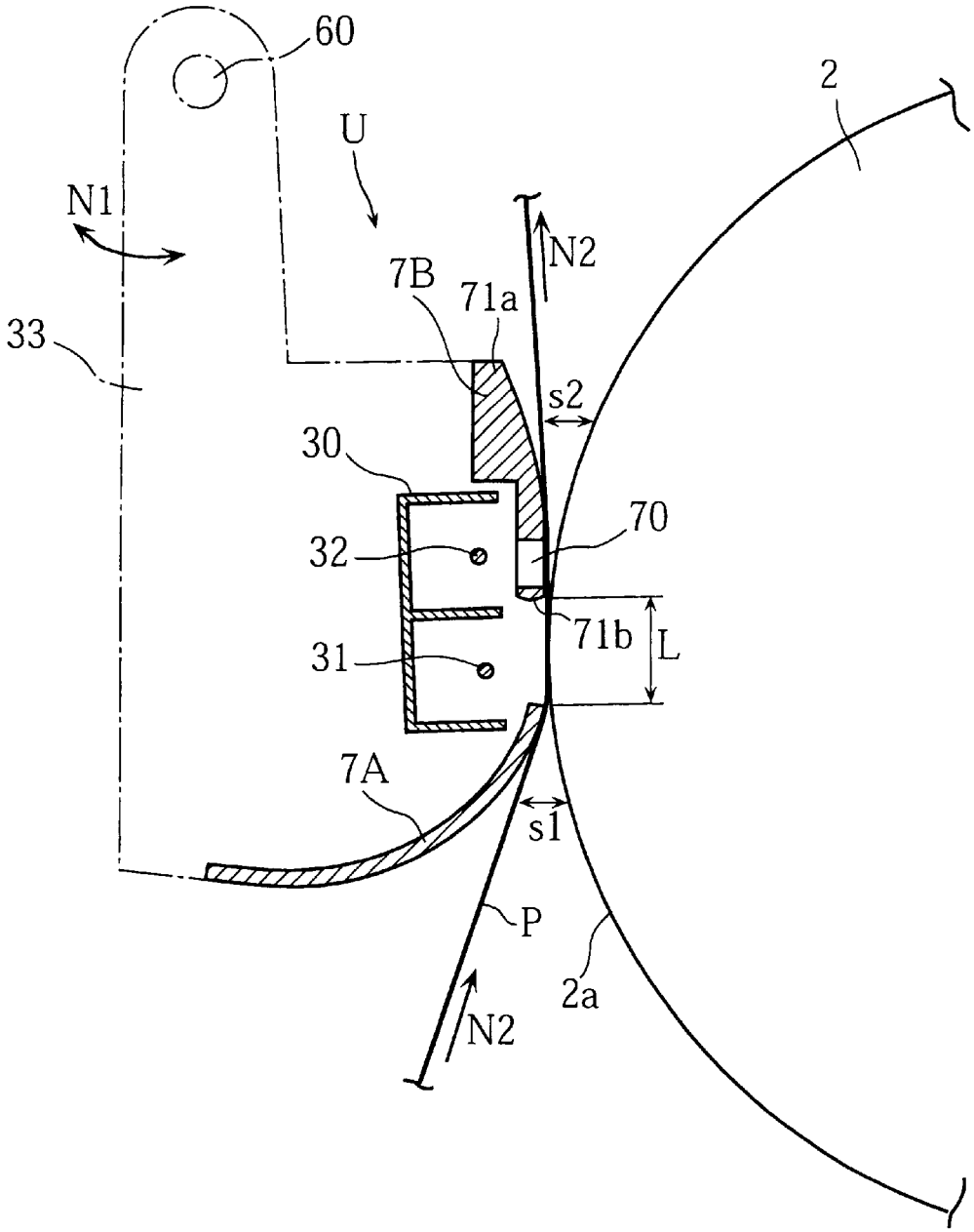
FIG. 2 is a sectional view illustrating the transfer unit of the printer of FIG. 1.
Figure 3:
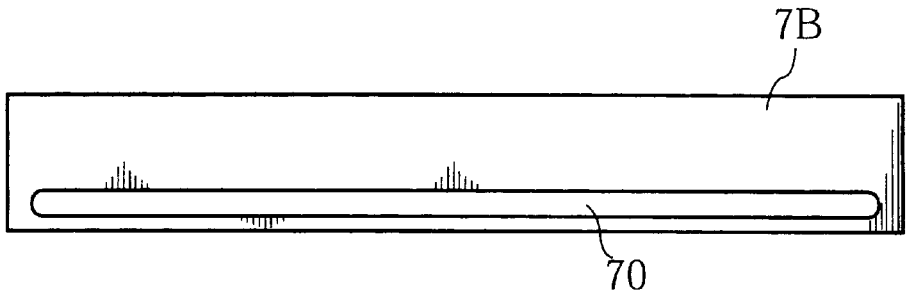
FIG. 3 is a front view of the second guide of the transfer unit shown in FIG. 2.

FIGS. 1–3 illustrate a printer according to a first embodiment of the present invention for printing an image on a surface of an elongated recording paper P. As shown in FIG. 1, the printer A includes a paper hopper 10, a photosensitive drum 2, a developer 40, a transfer unit U, a fixing unit 41, a stocker 11 and other parts which will be described later.

The paper hopper 10 stores an elongated recording paper P as repetitively and alternately folded. The recording paper P pulled out from the paper hopper 10 by a pair of tractors 50, 50*a* and a pair of transport rollers 50*b* is transported by a guide plate 53 and a guide roller 52*a* to a space between the photosensitive drum 2 and the transfer unit U. After passing through the space between the drum 2 and the transfer unit U, the recording paper P is transported by a plurality of guide rollers 52 and a pair of transport rollers 51 for storage in the stocker 11.

The photosensitive drum 2 has a surface (circumferential surface) 2*a* on which an electrostatic latent image is formed by an electrostatic latent image forming unit 4. The image forming unit 4 includes a cleaning brush 42, a cleaning blade 43, a charger 44 for uniformly charging the surface 2*a* of the photosensitive drum 2. The image forming unit 4 further includes a light exposure device 45 including an LED for example for exposing the surface 2*a* of the drum 2 with light based on the printing data after the drum 2 is charged by the charger 44, thereby forming an electrostatic latent image. The electrostatic latent image is developed by the developer 40 to provide a toner image on the surface 2*a* of the photosensitive drum 2. The toner image has a negative potential. The fixing unit 41, which may be of the flash type including a light source for example, functions to fix the toner image on the recording paper K.

As shown in FIG. 2, the transfer unit U includes a casing 30 accommodating a transfer wire 31 and a discharge wire 32, and a first and a second guides 7A, 7B. The casing 30 and the first and the second guides 7A, 7B are attached to a movable member 33 which is pivotable about a shaft 60 in the arrow N1 direction. The pivotal movement of the movable member 33 enables the transfer unit U to move between a set position close to the photosensitive drum 2 and a release position separated from the photosensitive drum 2. When the drum 2 is out of a printing operation, the transfer unit U is held at the release position for keeping the recording paper P out of contact with the surface 2*a* of the photosensitive drum 2.

The casing 30, the transfer wire 31 and the discharge wire 32 are structured similarly to those of a prior art printer. Specifically, the casing 30 has a box-like configuration elongated axially of the photosensitive drum 2 and having a front portion which is open toward the photosensitive drum 2. The transfer wire 31 and the discharge wire 32, which are formed of a metal, extend axially of the photosensitive drum 2 while being spaced from each other in the recording paper transport direction indicated by the arrow N2. The discharge wire 32 is arranged downstream from the transfer wire 31 in the paper transport direction N2. Longitudinally opposite ends of each wire 31, 32 are supported by the casing 30. A transfer current for generating potential for attracting toner flows through the transfer wire 31, whereas a discharge current for removing the charge from the recording paper P flows through the discharge wire 32.

The first and the second guides 7A, 7B are formed of a metal (e.g. aluminum) having a high wear-resistance. The first and the second guides 7A, 7B are elongated axially of the photosensitive drum 2 and substantially equal in length to the transfer wire 31 and the discharge wire 32.

The first guide 7A is arranged upstream from the transfer wire 31 in the paper transport direction N2 so as not to shield the transfer wire 31.

The second guide 7B has a first longitudinal edge 71*a* located downstream from the discharge wire 32 in the paper transport direction N2 and a second longitudinal edge 71*b* located upstream from the discharge wire 32 in the paper transport direction N2. The second guide 7B is formed with a slit 70 at a portion which is offset toward the second edge 71*b* in facing relationship to the discharge wire 32. The slit 70 serves as an unshielding portion. Owing to the provision of the slit 70, the discharge wire 32 is prevented from being shielded by the second guide 7B. As shown in FIG. 3, the slit 70 extends longitudinally of the second guide 7B (axially of the photosensitive drum 2) to reveal the discharge wire 32 substantially over the entire length thereof.

Figure 4:
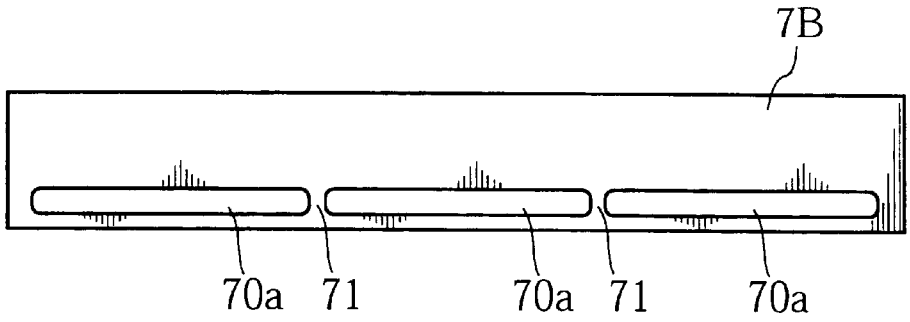
FIG. 4 is a front view of a second guide according to another embodiment of the present invention.

Alternatively, as shown in FIG. 4, a plurality of slits 70*a* may be arranged to make a line. In this case, the discharge wire 32*a* is partially shielded by portions 71 of the second guide 7B. However, such partial shielding does not considerably deteriorate the discharging effect for the recording paper P. As compared with the structure shown in FIG. 3, the structure shown in FIG. 4 can provide a greater mechanical strength around the slits 70*a*.

The image printing on the recording paper P using the above-described printer A is performed as follows. First, as shown in FIG. 2, the first and the second guides 7A, 7B are moved to the set position close to the surface 2*a* of the photosensitive drum 2. The recording paper P fed from the paper hopper 10 along the above-described transport path is guided by the first and the second guides 7A, 7B into contact with the surface 2*a* of the photosensitive drum 2. At this time, since the transfer current flowing through the transfer wire 31 charges the recording paper P to attract toner particles, the toner image formed on the surface 2*a* of the photosensitive drum 2 is transferred to the recording paper P.

Since the second edge 71*b* of the second guide 7B is located upstream from the discharge wire 32 in the paper transport direction N2, the distance L between the first guide 7A and the second guide 7B is shorter than in the prior art printer. Accordingly, the winding length of the recording paper P about the photosensitive drum 2 (circumferential contact length between the paper P and the drum 2) is smaller than that in the prior art printer. This reduces the possibility that the recording paper P becomes loose at the surface 2*a* of the photosensitive drum 2 or that the image transferred to the recording paper P is rubbed by the surface 2*a* of the photosensitive drum 2 due to a difference between the paper transport speed and the peripheral speed of the drum surface 2*a*. Thus, a printed image with a high quality can be obtained. Moreover, to reliably transfer a toner image onto the recording paper P, the recording paper P need be stably transported without largely shifting. For this purpose, it is preferable to narrow that the gaps s1, s2 defined between the recording paper P and the photosensitive drum 2 before and after the paper P contacts the drum 2. The printer of the present invention also meets such a requirement, so that the printing quality can be further enhanced.

Since the discharge wire 32 is unshielded through the slit 70 to face the recording paper P, the electric charge of the recording paper P can be properly released by energizing the discharge wire 32. For smooth removal of the recording paper P from the surface 2*a* of the photosensitive drum 2, it is preferable that the electric charge of the recording paper P be released when or immediately after the recording paper P begins to separate from the surface 2*a* of the drum 2. The printer of this embodiment also meets such a requirement.

Figure 5:
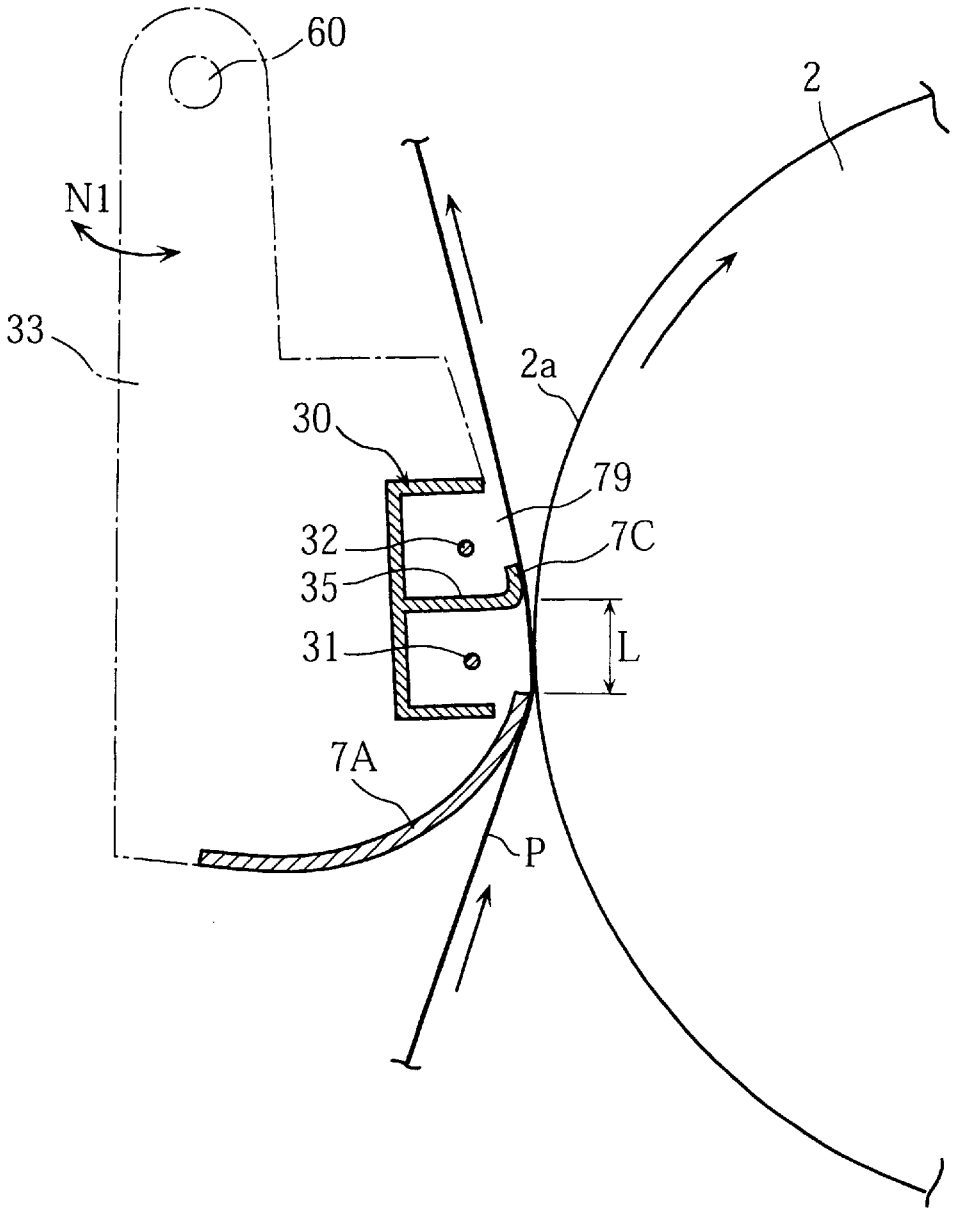
FIG. 5 is a sectional view illustrating a transfer unit according to a second embodiment of the present invention.
Figure 6:
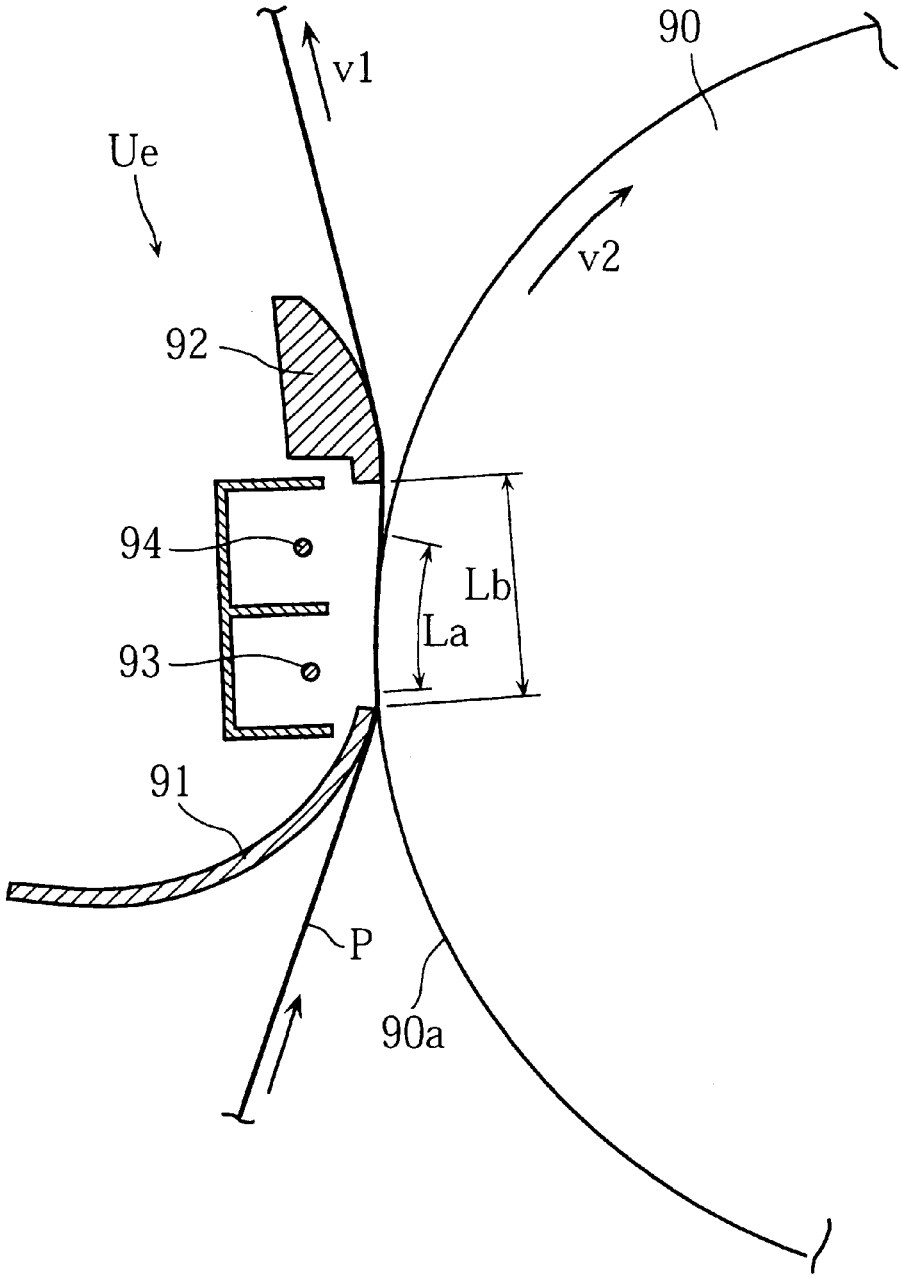
FIG. 6 PRIOR ART
FIG. 6 is a sectional view illustrating a prior art transfer unit.

Referring to FIG. 5, a printer according to a second embodiment of the present invention will be described. In this figure, the elements which are identical or similar to those of the first embodiment are designated by the same reference signs as those used for the first embodiment.

In the second embodiment, a casing 30 has a partition wall 35 which separates the transfer wire 31 from the discharge wire 32 and which has a bent tip end serving as a second guide 7C. The second guide 7C is located upstream from the discharge wire 32 in the paper transport direction. The dimension of the second guide 7C in the paper transport direction is so set as to avoid shielding the discharge wire 32 at the front. A front portion 79 of the casing 30 serves as an unshielding portion.

Also with this structure, the distance L between the first guide 7A and the second guide 7C is shorter than that in the prior art printer, thereby decreasing the winding length of the recording paper P about the photosensitive drum 2. Therefore, similarly to the first embodiment, the printing quality can be enhanced. In this way, the second guide 7C may comprise a part of the casing 30 supporting the transfer wire 31 and the discharge wire 32. With such a structure, the number of parts of the transfer unit can be decreased. Moreover, though not illustrated, the first guide may also comprise a part of the casing 30.

The present invention is not limited to the above described embodiments, and the specific structure of the printer and the transfer unit may be modified in various ways.

The material of the first and the second guide is not limitative. Further, the photosensitive drum may be replaced with a photosensitive endless belt. Moreover, although the printer of the present invention is most suitable for printing on a continuous recording paper, the present invention is not limited to a specific use of the printer or to a specific kind of recording paper.

As described above, by decreasing the distance between the first guide and the second guide, the winding length of the recording paper about the photosensitive member can be decreased. Therefore, the printer or transfer unit of the present invention is capable of enhancing the image quality while preventing a deterioration of the discharging effect by the discharge member.

What is claimed is:

1. A printer comprising:

a photosensitive member having a surface for forming a toner image;

a transfer member for passing a transfer current for transferring the toner image onto a recording paper, the transfer member being arranged to face said surface of the photosensitive member;

a discharge member for passing a discharge current for performing discharge of the recording paper, the discharge member being arranged downstream from the transfer member in a recording paper transport direction to face said surface of the photosensitive member;

a first guide arranged upstream from the transfer member in the recording paper transport direction for guiding the recording paper; and a second guide arranged downstream from the first guide in the recording paper transport direction for guiding the recording paper;

wherein the second guide includes a contact portion located between the transfer member and the discharge member in the recording paper transport direction for contact with the recording paper, the contact portion being positioned adjacent an unshielding portion for exposing the discharge member relative to said surface of the photosensitive member, the unshielding portion comprising at least one slit formed in the second guide, the slit being closed on an upstream side as viewed in the recording paper transport direction.

2. The printer according to claim 1, wherein the second guide extends from a first position located between the transfer member and the discharge member in the recording paper transport direction to a second position located downstream from the discharge member in the recording paper transport direction, an edge of the second guide located at the first position serving as the contact portion.

3. The printer according to claim 2, wherein said one slit extends longitudinally along and adjacent said edge of the second guide.

4. The printer according to claim 2, wherein the unshielding portion comprises an additional slit formed in the second guide, the additional slit and said one slid being arranged in a row extending longitudinally along and adjacent said edge of the second guide.

5. A printer comprising:

a photosensitive member having a surface for forming a toner image;

a transfer member for passing a transfer current for transferring the toner image onto a recording paper, the transfer member being arranged to face said surface of the photosensitive member;

a discharge member for passing a discharge current for performing discharge of the recording paper, the discharge member being arranged downstream from the transfer member in a recording paper transport direction to face said surface of the photosensitive member;

a first guide arranged upstream from the transfer member in the recording paper transport direction for guiding the recording paper; and a second guide arranged downstream from the first guide in the recording paper transport direction for guiding the recording paper;

wherein the second guide includes a contact portion located between the transfer member and the discharge member in the recording paper transport direction for contact with the recording paper, the contact portion being positioned adjacent an unshielding portion for exposing the discharge member relative to said surface of the photosensitive member, wherein the transfer member and the discharge member are separated from each other by a partition wall which also serves as the second guide, the contact portion being provided by a forward end of the partition wall, wherein the forward end of the partition wall serving as the contact portion is bent downstream in the recording paper transport direction.

6. A transfer unit to be brought into contact with a recording paper, comprising:

a transfer member arranged to face the recording paper for passing a transfer current;

a discharge member for passing a discharge current for performing discharge of the recording paper, the discharge member being arranged to face the recording paper downstream from the transfer member in a recording paper transport direction;

a first guide arranged upstream from the transfer member in recording paper transport direction for guiding the recording paper; and a second guide arranged downstream from the first guide in the recording paper transport direction for guiding the recording paper;

wherein the second guide includes a contact portion located between the transfer member and the discharge member in the recording paper transport direction for contact with the recording paper, the contact portion being positioned adjacent an unshielding portion for exposing the discharge member relative to the recording paper, the unshielding portion, comprising at least one slit formed in the second guide, the slit being closed on an upstream side as viewed in the recording paper transport direction.

7. The transfer unit according to claim 6, wherein the second guide extends from a first position located between the transfer member and the discharge member in the recording paper transport direction to a second position located downstream from the discharge member in the recording paper transport direction, an edge of the second guide located at the first position serving as the contact portion.

8. The transfer unit according to claim 7, wherein said one slit extends longitudinally along and adjacent said edge of the second guide.

9. The transfer unit according to claim 7, wherein the unshielding portion comprises an additional slit formed in the second guide, the additional slit and said one slit being arranged in a row extending longitudinally along and adjacent said edge of the second guide.

10. A transfer unit to be brought into contact with a recording paper, comprising:

a transfer member arranged to face the recording paper for passing a transfer current;

a discharge member for passing a discharge current for performing discharge of the recording paper, the discharge member being arranged to face the recording paper downstream from the transfer member in a recording paper transport direction;

a first guide arranged upstream from the transfer member in the recording paper transport direction for guiding the recording paper; and a second guide arranged downstream from the first guide in the recording paper transport direction for guiding the recording paper;

wherein the second guide includes a contact portion located between the transfer member and the discharge member in the recording paper transport direction for contact with the recording paper, the contact portion being positioned adjacent an unshielding portion for exposing the discharge member relative to the recording paper, wherein the transfer member and the discharge member are separated from each other by a partition wall which also serves as the second guide, the contact portion being provided by a forward end of the partition wall, wherein the forward end of the partition wall serving as the contact portion is bent downstream in the recording paper transport direction.

* * * * *